US007850101B2

(12) United States Patent
Walmer

(10) Patent No.: US 7,850,101 B2
(45) Date of Patent: Dec. 14, 2010

(54) LINE MARKING APPARATUS

(75) Inventor: Thomas Walmer, Hartwood, VA (US)

(73) Assignee: Sightline, LC, Culpeper, VA (US)

( * ) Notice: Subject to any disclaimer, the term of this patent is extended or adjusted under 35 U.S.C. 154(b) by 154 days.

(21) Appl. No.: 12/275,311

(22) Filed: Nov. 21, 2008

(65) Prior Publication Data

US 2010/0127100 A1 May 27, 2010

(51) Int. Cl.
*A01C 23/00* (2006.01)

(52) U.S. Cl. ..... 239/662; 239/99; 239/150; 239/151; 239/159; 239/304; 239/575; 239/583; 239/663; 239/DIG. 23; 404/94; 404/101

(58) Field of Classification Search ..... 239/67, 239/69, 99, 100, 146, 150, 151, 159, 302–304, 239/373, 548, 566, 569, 575, 583, 650, 662, 239/663, DIG. 23; 404/93, 94, 101
See application file for complete search history.

(56) References Cited

U.S. PATENT DOCUMENTS

| | | | | | |
|---|---|---|---|---|---|
| 2,691,923 | A | | 10/1954 | Huck | |
| 3,289,899 | A | * | 12/1966 | Miller et al. | 239/663 |
| 4,256,261 | A | * | 3/1981 | Gurney | 239/150 |
| 4,518,121 | A | | 5/1985 | Smith | |
| 5,054,959 | A | | 10/1991 | Wilson et al. | |
| 5,114,268 | A | | 5/1992 | Marcato | |
| 5,169,262 | A | | 12/1992 | Wilson et al. | |
| 5,294,798 | A | * | 3/1994 | Hartman | 404/94 |
| 5,368,232 | A | | 11/1994 | Schroeder | |
| 5,540,518 | A | * | 7/1996 | Wambold | 404/94 |
| 5,785,760 | A | | 7/1998 | Sconyers et al. | |
| 5,947,385 | A | * | 9/1999 | Lanerd et al. | 239/159 |
| 5,951,201 | A | | 9/1999 | Jones | |
| 6,413,012 | B1 | | 7/2002 | Jones | |
| 6,419,165 | B1 | | 7/2002 | Schroeder | |
| 6,511,259 | B1 | * | 1/2003 | Khieu et al. | 404/101 |
| 6,547,158 | B1 | | 4/2003 | Smith | |

OTHER PUBLICATIONS

Highway Safety Marking Sphere Dispenser, VISIGUN; Marketing Borcure; 2 pages.

* cited by examiner

*Primary Examiner*—Steven J Ganey
(74) *Attorney, Agent, or Firm*—Brian J. Teague

(57) ABSTRACT

An apparatus for applying paint and reflective glass beads to a surface that comprises an airless paint sprayer system, a bead dispensing system, a chassis, a power source, and a user-activated control switch. The airless paint sprayer system comprises a paint reservoir, one or more airless spray heads for spraying paint onto the surface, and a pump for pumping paint from the reservoir to the spray heads. The bead dispensing system comprises a bead reservoir, one or more bead dispensing nozzles for dispensing beads onto the paint sprayed onto the surface by the spray heads, an air reservoir for holding pressurized air, one or more pneumatic cylinders configured for opening and closing a corresponding dispensing nozzle, and one or more flow control regulators for controlling air into and out of a corresponding pneumatic cylinder.

9 Claims, 3 Drawing Sheets

LINE MARKING APPARATUS

FIELD OF THE INVENTION

The present invention relates to an apparatus for the application of paint and reflective beads to pavement surfaces, such as a parking lot, roadway, or airport runway.

BACKGROUND

Stripes are applied to roadways, parking lots, airport runways and taxiways, and the like for directing the movement and placement of vehicles. Durable paints are sprinkled with small reflective glass beads to enable nighttime visibility of the lines due to reflection by the beads of vehicle headlights.

Prior art painting systems used to apply marking lines to long lengths of highway generally use large vehicles dedicated to single use. Because of their large size, lack of maneuverability, high labor consumption and expense, these machines are generally inappropriate for use on smaller projects, such as parking lots, warehouse floors, short sections of highway repair and the like. Such applications generally require enhanced maneuverability because of short lines, line discontinuity, and the presence of obstacles to be avoided.

Prior art walk behind striping machines are widely used for striping parking lots, warehouse floors, short sections of highway repair and the like. The walk behind machine works well for striping short lines. Walk behind striping machines are typically available in airless or compressed air versions. In the compressed air version, an onboard air compressor and/or compressed air storage tank supplies pressurized air that is used to disperse the paint and to disperse the glass beads into the applied paint. However, many painting contractors prefer the ease of use and superior painting performance of an airless system. In the airless version, paint is pumped from a reservoir to specially designed airless spray heads. As the airless versions do not generally have a source of compressed air, a gravity-fed and mechanically-actuated bead dispenser is used. While the airless paint sprayer offers superior painting performance, the gravity-fed and mechanically-actuated bead dispenser is generally considered inferior to the version that uses compressed air.

BRIEF SUMMARY

Embodiments of the present invention provide a walk behind airless paint sprayer with a compressed air bead dispenser, for painting reflective lines on roadways, parking lots, airport runways and taxiways, and the like.

In one embodiment of the invention, an apparatus for applying paint and reflective glass beads to a surface comprises an airless paint sprayer system, a bead dispensing system, a chassis, a power source, and a user-activated control switch. The airless paint sprayer system comprises a paint reservoir, one or more airless spray heads for spraying paint onto the surface, and a hydraulic pump for pumping paint from the reservoir to the spray heads. The bead dispensing system comprises a bead reservoir, one or more bead dispensing nozzles for dispensing beads onto the paint sprayed onto the surface by the spray heads, an air reservoir for holding pressurized air, one or more pneumatic cylinders configured for opening and closing a corresponding dispensing nozzle, and one or more flow control regulators for controlling air into and out of a corresponding pneumatic cylinder. The chassis comprises a frame, a plurality of wheels, and one or more handles. The airless paint sprayer system and the bead dispensing system are mounted on the chassis. The power source powers the hydraulic pump.

The user-activated switch is mounted on one of the handles and controls the spray heads and the pneumatic cylinders. Activating the switch (i) opens the spray heads thereby causing the spray heads to spray paint and (ii) causes pressurized air to flow through the flow control regulators to the respective pneumatic cylinders thereby opening the respective bead dispensing nozzles and causing the bead dispensing nozzles to dispense beads. Deactivating the switch (i) closes the spray heads thereby stopping the flow of paint from the spray heads and (ii) causes pressurized air to stop flowing through the flow control regulators to the respective pneumatic cylinders thereby closing the respective bead dispensing nozzles and preventing the bead dispensing nozzles from dispensing beads. Each bead dispensing nozzle is mounted a predetermined distance rearward of a corresponding spray head. Each flow control regulator is configured to delay the opening and closing of the corresponding pneumatic cylinder for an amount of time determined based on the rearward distance and an anticipated speed at which the apparatus moves during application of the paint and beads.

The bead dispensing nozzle may comprise a cylindrical hopper, a conical piston with a connecting rod to the pneumatic cylinder, a shroud extending downward from the hopper and having an open bottom end, and a mesh screen spanning the open bottom end of the shroud. The mesh screen may curve downward from the open bottom end of the shroud. The mesh screen may have a semicylindrical shape. The longitudinal axis of the semicylindrically shaped mesh screen may correspond to a direction of travel of the apparatus when the apparatus is moving forward in a straight line.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1. is a schematic block diagram of an apparatus for applying paint and reflective glass beads to a surface, in accordance with one embodiment of the invention;

DETAILED DESCRIPTION

Many specific details of preferred embodiments of the invention are set forth in the following description and in the figures to provide a thorough understanding of such embodiments. One skilled in the art, however, will understand that the present invention may have additional embodiments, or that the present invention may be practiced without several of the details described in the following description. As such, this invention should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
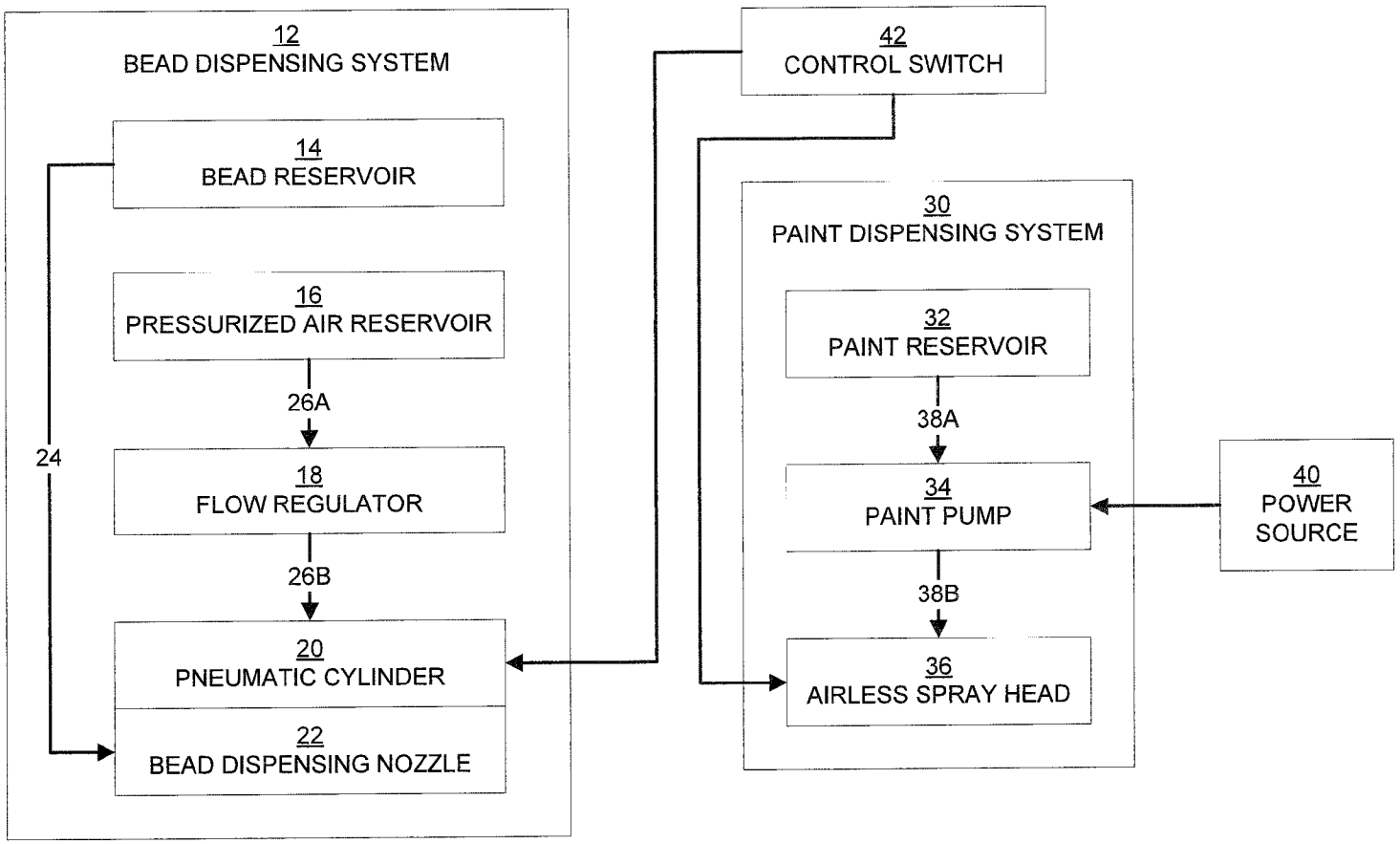

Referring now to FIG. 1, an apparatus for applying paint and reflective glass beads to a surface is illustrated in accordance with one embodiment of the invention. The apparatus 10 comprises an airless paint dispensing system 30, a reflective bead dispensing system 12, a power source 40, a control switch 42, and a chassis (not illustrated) upon which all these components are mounted.

The airless paint dispensing system 30 comprises a paint reservoir 32 for storing a quantity (e.g., five gallons) of paint to be applied to the surface, one or more airless spray heads 36 for spraying the paint onto the surface, a pump 34 for pumping paint from the reservoir to the spray heads, paint tubing 38A for conveying paint from the paint reservoir to the pump and paint tubing 38B for conveying paint from the pump to the spray heads. A power source 40, such as a gasoline-powered engine, powers the pump. The pump may be a hydraulic pump that is configured to maintain a constant, preset pressure (e.g., 2000 psi) in the paint tubing. If paint is not spraying from the spray heads, the pump will quickly reach the preset pressure and turn off. When one or more spray heads are opened, the pressure in the paint tubing drops below the preset limit and the pump turns on and begins pumping paint which is sprayed from the spray heads. While embodiments of the invention are described in which a hydraulic pump is used to pump paint to the spray heads, other types of pumps (e.g., electric pumps) may be used in alternative embodiments of the invention.

The bead dispensing system 12 comprises a bead reservoir 14, one or more bead dispensing nozzles 22 for dispensing beads onto the paint sprayed onto the surface by the spray heads, an air reservoir 16 for holding pressurized air, one or more pneumatic cylinders 20, one or more flow control regulators 18, bead tubing 24 for conveying beads from the bead reservoir to the dispensing nozzles (the flow of beads is gravity assisted), air tubing 26A for conveying pressurized air from the air reservoir to the flow control regulators and air tubing 26B for conveying pressurized air from the flow regulators to the pneumatic cylinders. Each pneumatic cylinder controls the opening and closing of a corresponding dispensing nozzle. Each flow control regulator controls the flow of air into and out of a corresponding pneumatic cylinder. The operation of the flow control regulators, pneumatic cylinders, and bead dispensing nozzles, as well as the control of these components by the control switch 42, are discussed in more detail below.

Figure 2:
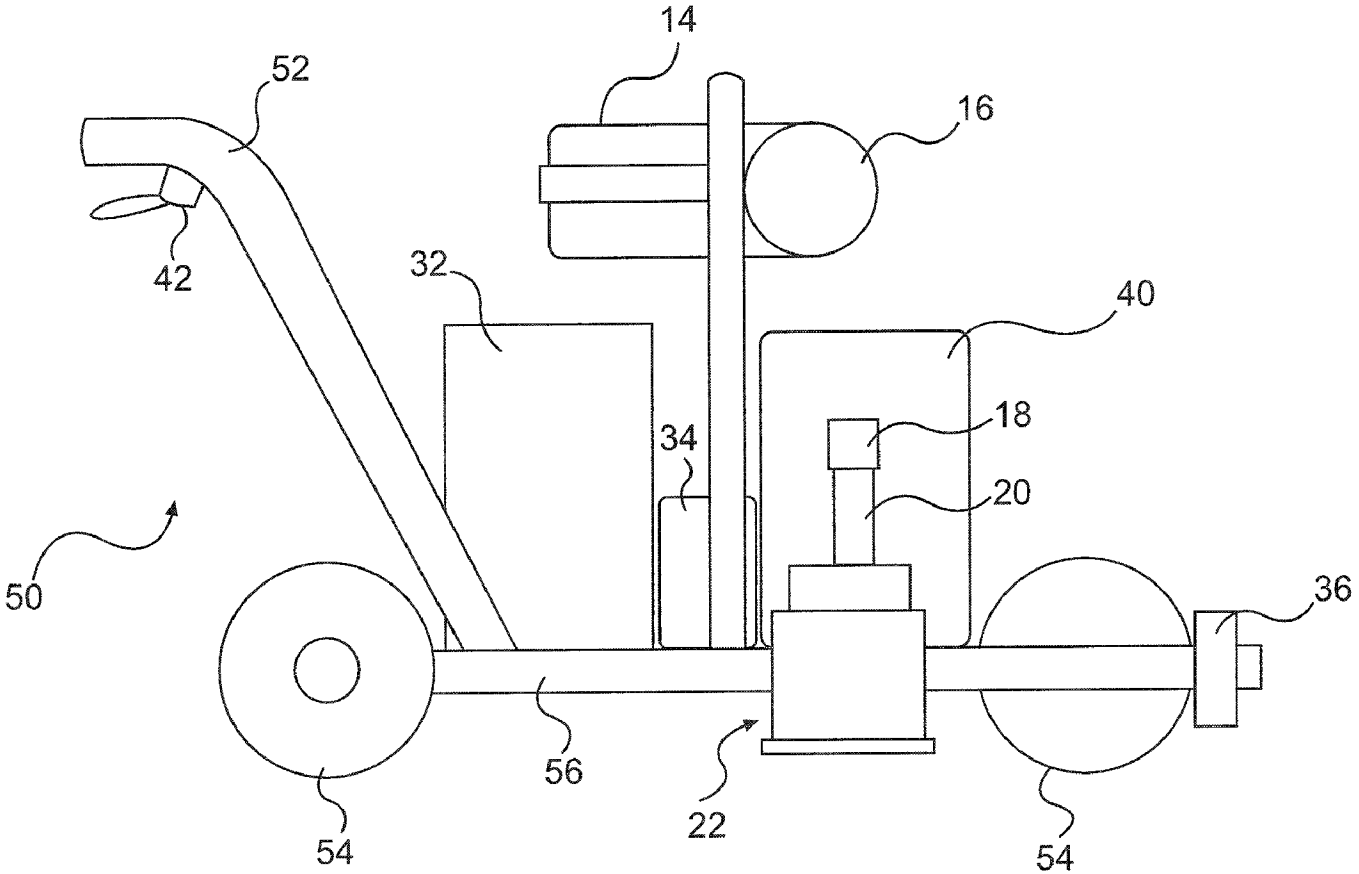
FIG. 2 is a simplified side view of an apparatus for applying paint and reflective glass beads to a surface, in accordance with one embodiment of the invention.

Referring now to FIG. 2, a simplified side view of an apparatus for applying paint and reflective glass beads to a surface is illustrated in accordance with one embodiment of the invention. As seen in FIG. 2, the apparatus comprises a chassis 50 which in turn comprises a frame 56, a plurality of wheels 54 (typically three), and one or more handles 52. The components of the airless paint sprayer system (paint reservoir 32, paint pump 34, and spray head 36), the components of the bead dispensing system (bead reservoir 14, air reservoir 16, flow regulator 18, pneumatic cylinder 20, bead dispensing nozzle 22), and the power supply 40 are mounted on the frame 56. For clarity purposes, the air tubing and paint tubing are not illustrated in FIG. 2. Similarly, only one paint spray head and only one regulator/cylinder/nozzle combination are illustrated, although the apparatus may comprise more than one. The handles 52 (only one is seen in FIG. 52) enable a user to physically control the apparatus. Additionally, a plurality of user control switches may be mounted on the handle, such as controls to start/stop the engine and start/stop movement of the apparatus. One of the plurality of user control switches is a paint/bead control switch 42 that controls the spray heads and the pneumatic cylinder(s). The control switch 42 may be a single switch that controls both the spray heads and the pneumatic cylinder(s). Alternatively, switch 42 may be two separate switches that are mechanically or otherwise linked to enable activation with a single user action.

Activating switch 42 opens the spray heads thereby causing paint (which is pressurized by the hydraulic pump as discussed above) to be sprayed downward onto the surface, and causes pressurized air to flow through the flow control regulators to the respective pneumatic cylinders thereby opening the respective bead dispensing nozzles and causing the bead dispensing nozzles to dispense beads. Deactivating switch 42 closes the spray heads thereby causing paint to no longer be sprayed onto the surface, and causes pressurized air to stop flowing to the flow control regulators to the respective pneumatic cylinders thereby closing the respective bead dispensing nozzles and preventing the bead dispensing nozzles from dispensing beads.

Figure 3B:
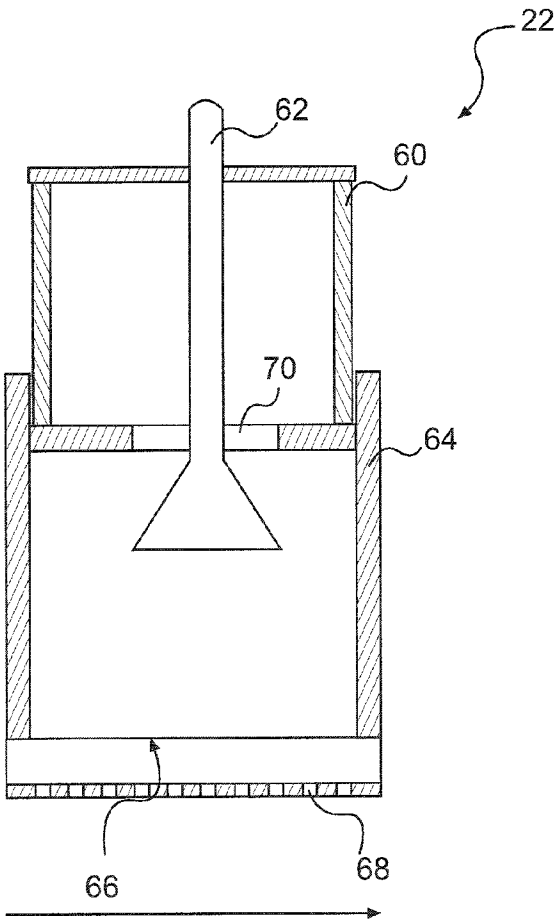
FIG. 3B is a cross-sectional side view of the bead dispensing nozzle of FIG. 3A, rotated 90 degrees and in an open (dispensing) position.
Figure 3A:
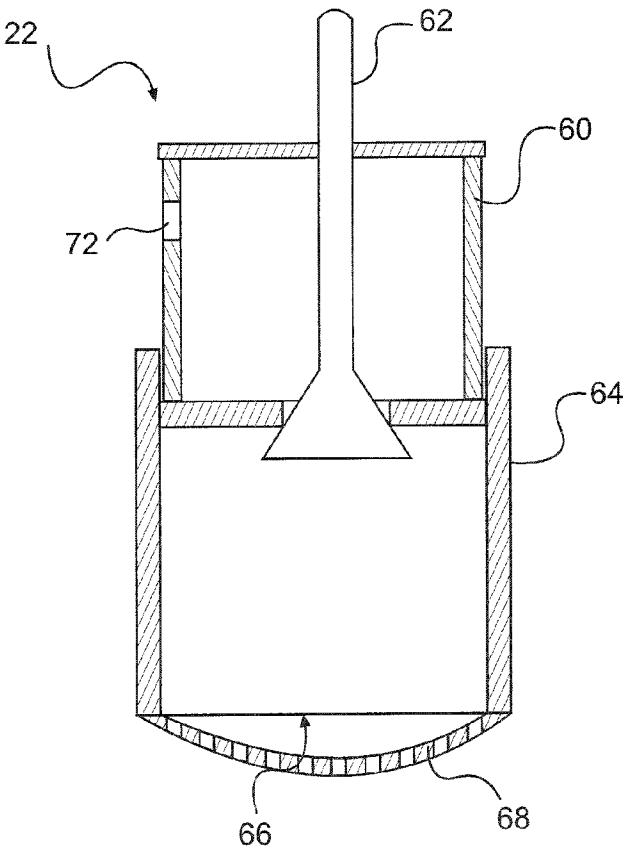
FIG. 3A is a cross-sectional side view of a bead dispensing nozzle of an apparatus for applying paint and reflective glass beads to a surface, in a closed (non-dispensing) position, in accordance with one embodiment of the invention.

FIG. 3A illustrates a cross-sectional side view of a bead dispensing nozzle 22 in a closed (non-dispensing) position, and FIG. 3B illustrates a cross-sectional side view of the same bead dispensing nozzle rotated 90 degrees and in an open (dispensing) position. The bead dispensing nozzle 22 comprises a cylindrical hopper 60, a conical piston 62 with a rod connecting the piston to the pneumatic cylinder (not illustrated), a cylindrical shroud 64 extending downward from the hopper and having an open bottom end 66, and a mesh screen 68 spanning the open bottom end of the shroud. The conical portion of the piston obstructs a hole 70 in the bottom floor of the hopper when the piston is in the up or closed position (FIG. 3A). The diameter of the open bottom end of the shroud is substantially equal to the width of the line of paint sprayed by the corresponding spray head.

The hopper 60 receives beads from the bead reservoir via tubing attached to a bead inlet 72. As the beads are gravity-fed from the reservoir, the hopper is continuously replenished as needed as long as there is a sufficient amount of beads in the reservoir. The beads are contained within the hopper until activation of switch 42 causes air to flow to the pneumatic cylinder, thereby moving the piston from the up/closed position (FIG. 3A) to the down/open position (FIG. 3B). When the cylinder is in the down/open position, beads flow (by gravity) from the hopper through hole 70 and out the open bottom end of the shroud. The conical shape of the piston helps disperse the beads as the beads fall.

To further assist in proper dispersion of the beads, a mesh screen 68 spans the open bottom end of the shroud. Without this screen, the beads will be concentrated on the longitudinal edges of the painted strip, conforming to the circular opening as the apparatus moves forwards. The screen in the semicylindrical shape deflects the heavy flow of beads from the edges and disperses them more evenly across the width of the painted strip. In the embodiment illustrated in FIGS. 3A and 3B, the mesh screen has a semicylindrical shape. That is to say, the screen has a shape of a longitudinal cross-section of a cylinder. The screen is oriented such that the longitudinal axis of the semicylindrically shaped mesh screen corresponds to the direction of travel of the apparatus when the apparatus is moving forward in a straight line. Thus, in FIG. 3A, the direction of travel is perpendicular to the drawing sheet; and in FIG. 3B, the direction of travel is left to right along the drawing sheet (as illustrated by the arrow in FIG. 3B). This semicylindrical shape causes a somewhat higher concentration of beads in the center of the painted line (i.e., directly below the lowest point of the screen) than on the sides of the painted line, which reduces the number of beads that fall or bounce on the edges of the painted line.

Each paint spray head and its corresponding bead dispensing nozzle are mounted such that they are aligned along the direction of travel of the apparatus when the apparatus is moving forward in a straight line. This alignment ensures that the beads from any particular bead dispensing nozzle are dropped onto the line painted by the corresponding spray head. Each bead dispensing nozzle is mounted a predetermined distance rearward of its corresponding spray head. If a bead dispensing nozzle were to begin dispensing beads at the same time the corresponding spray head begins spraying paint, the beads would begin dispensing too early (i.e., the bead dispensing nozzle would dispense beads over an unpainted surface for a distance equal to the distance between the spray head and the bead dispensing nozzle). Similarly, if a bead dispensing nozzle were to stop dispensing beads at the same time the corresponding spray head stopped spraying paint, the beads would stop dispensing too early (i.e., the bead dispensing nozzle would fail to dispense beads over a portion of the painted surface equal to the distance between the spray head and the bead dispensing nozzle).

It is desirable for ease of operation to have a single switch (or two mechanically-linked switches) that controls both the spray heads and the bead dispensing nozzles. Thus, it is desirable to introduce a delay into the control of the bead dispensing nozzles such that both the spray heads and the bead dispensing nozzles can be controlled with a single switch (or two mechanically-linked switches) while ensuring that the bead dispensing nozzles dispense beads over the entire painted line and not over a non-painted surface.

Due to physical space constraints involved in mounting the components of the system on the chassis, each bead dispensing nozzle typically must be mounted some distance rearwards of a corresponding spray head. Therefore, if both paint and beads stop flowing simultaneously upon deactivating the switch (as would typically occur with mechanically-actuated bead dispensing nozzles), a length of painted line equal to the rearward distance mount of the bead dispensing nozzle will not receive beads. Pneumatically controlled bead dispensing nozzles alone (i.e., without flow control regulators) will not resolve the problem with synchronizing of materials application, but utilizing compressed air allows for the solution provided by the flow control regulators. Embodiments of the present invention comprise one or more flow control regulators (typically, one for each bead dispensing nozzle) that is configured to delay the opening and closing of the corresponding pneumatic cylinder. The bead dispensing nozzles are controlled by pneumatic cylinders that open with compressed air and close by spring action. A minimum pressure is required to overcome the spring tension and open the nozzle and, conversely, a decreasing pressure allows the spring to overcome the air pressure and close the nozzle. Each flow control regulator is configured to gradually meter air into and out of each cylinder to delay attaining and reducing the required operating pressures, thereby delaying the opening and closing of the corresponding cylinder for an amount of time determined based on the rearward distance and an anticipated speed at which the apparatus moves during application of the paint and beads. The flow control regulators are selected (in the case of a non-adjustable regulator) or configured (in the case of an adjustable regulator) such that the opening and closing of the bead dispensing nozzles is delayed for an amount of time that is determined based on the rearward distance and an anticipated speed at which the apparatus moves during application of the paint and beads. In other words, the delay is equal to the amount of time required for the apparatus to travel a distance equal to the distance between the spray heads and the bead dispensing nozzles. Thus, the delay ensures that the paint begins spraying and the beads begin dropping at the same location (i.e., the beginning of the painted line) and that the paint stops spraying and the beads stop dropping at the same location (i.e., the end of the painted line).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. An apparatus for applying paint and reflective glass beads to a surface, the apparatus comprising:

an airless paint sprayer system comprising a paint reservoir, one or more airless spray heads for spraying paint onto the surface, and a pump for pumping paint from the reservoir to the spray heads;

a bead dispensing system comprising a bead reservoir, one or more bead dispensing nozzles for dispensing beads onto the paint sprayed onto the surface by the spray heads, an air reservoir for holding pressurized air, one or more pneumatic cylinders configured for opening and closing a corresponding dispensing nozzle, and one or more flow control regulators for controlling air into and out of a corresponding pneumatic cylinder;

a chassis upon which the airless paint sprayer system and the bead dispensing system are mounted, the chassis comprising a frame, a plurality of wheels, and one or more handles;

a power source for powering the pump; and a user-activated switch mounted on one of the handles for controlling the spray heads and the pneumatic cylinders, such that activating the switch (i) opens the spray heads thereby causing the spray heads to spray paint and (ii) causes pressurized air to flow through the flow control regulators to the respective pneumatic cylinders thereby opening the respective bead dispensing nozzles and causing the bead dispensing nozzles to dispense beads, and such that deactivating the switch (i) closes the spray heads thereby preventing the spray heads from spraying paint and (ii) causes pressurized air to stop flowing through the flow control regulators to the respective pneumatic cylinders thereby closing the respective bead dispensing nozzles and preventing the bead dispensing nozzles from dispensing beads;

wherein each bead dispensing nozzle is mounted a predetermined distance rearward of a corresponding spray head, and wherein each flow control regulator is configured to delay the opening and closing of the corresponding pneumatic cylinder for an amount of time determined based on the rearward distance and an anticipated speed at which the apparatus moves during application of the paint and beads; and wherein each bead dispensing nozzle comprises a cylindrical hopper, a conical piston with a connecting rod to the pneumatic cylinder, a shroud extending downward from the hopper and having an open bottom end, and a mesh screen spanning the open bottom end of the shroud.

2. The apparatus of claim 1, wherein the mesh screen curves downward from the open bottom end of the shroud.

3. The apparatus of claim 2, wherein the mesh screen has a semicylindrical shape.

4. The apparatus of claim 3, wherein a longitudinal axis of the semicylindrically shaped mesh screen corresponds to a direction of travel of the apparatus when the apparatus is moving forward in a straight line.

5. An apparatus for applying paint and reflective glass beads to a surface, the apparatus comprising:

an airless paint sprayer system comprising a paint reservoir, one or more airless spray heads for spraying paint onto the surface, and a pump for pumping paint from the reservoir to the spray heads;

a bead dispensing system comprising a bead reservoir, one or more bead dispensing nozzles for dispensing beads onto the paint sprayed onto the surface by the spray heads, an air reservoir for holding pressurized air, and one or more pneumatic cylinders configured for opening and closing a corresponding dispensing nozzle;

a chassis upon which the airless paint sprayer system and the bead dispensing system are mounted, the chassis comprising a frame, a plurality of wheels, and one or more handles;

a power source for powering the pump; and a user-activated switch mounted on one of the handles for controlling the spray heads and the pneumatic cylinders, such that activating the switch (i) opens the spray heads thereby causing the spray heads to spray paint and (ii) causes pressurized air to flow to the respective pneumatic cylinders thereby opening the respective bead dispensing nozzles and causing the bead dispensing nozzles to dispense beads, and such that deactivating the switch (i) closes the spray heads thereby preventing the spray heads from spraying paint and (ii) causes pressurized air to stop flowing to the respective pneumatic cylinders thereby closing the respective bead dispensing nozzles and preventing the bead dispensing nozzles from dispensing beads;

wherein the bead dispensing nozzle comprises a cylindrical hopper, a conical piston with a connecting rod to the pneumatic cylinder, a shroud extending downward from the hopper and having an open bottom end, and a mesh screen spanning the open bottom end of the shroud.

6. The apparatus of claim 5, wherein the mesh screen curves downward from the open bottom end of the shroud.

7. The apparatus of claim 6, wherein the mesh screen has a semicylindrical shape.

8. The apparatus of claim 7, wherein a longitudinal axis of the semicylindrically shaped mesh screen corresponds to a direction of travel of the apparatus when the apparatus is moving forward in a straight line.

9. The apparatus of claim 5, further comprising:

one or more flow control regulators for controlling air into and out of a corresponding pneumatic cylinder;

wherein activating the switch causes pressurized air to flow through the flow control regulators to the respective pneumatic cylinders and deactivating the switch causes pressurized air to stop flowing through the flow control regulators to the respective pneumatic cylinders, wherein each bead dispensing nozzle is mounted a predetermined distance rearward of a corresponding spray head, and wherein each flow control regulator is configured to delay the opening and closing of the corresponding pneumatic cylinder for an amount of time determined based on the rearward distance and an anticipated speed at which the apparatus moves during application of the paint and beads.

* * * * *